US005829354A

United States Patent [19]

Buckley

[11] Patent Number: 5,829,354

[45] Date of Patent: Nov. 3, 1998

[54] METHOD AND FILM FOR COATING A TRANSFER CYLINDER IN A PRINTING PRESS

[75] Inventor: Larry A. Buckley, San Antonio, Tex.

[73] Assignee: Russell Lewis Chilton Hill

[21] Appl. No.: 984,872

[22] Filed: Dec. 4, 1997

[51] Int. Cl.[6] ..... B41F 1/28

[52] U.S. Cl. ..... 101/483; 101/420; 101/422; 101/217

[58] Field of Search ..... 428/909; 101/216, 101/217, 420, 422, 416.1, 483

[56] References Cited

U.S. PATENT DOCUMENTS

| | | | |
|---|---|---|---|
| 2,085,845 | 7/1937 | Binkley | 101/420 |
| 4,694,750 | 9/1987 | Green | 101/426 |
| 4,912,824 | 4/1990 | Baran | 29/121.2 |
| 4,932,319 | 6/1990 | Switall | 101/147 |
| 5,090,686 | 2/1992 | Kemp et al. | 271/277 |
| 5,343,807 | 9/1994 | Hackelborger et al. | 101/415.1 |
| 5,413,044 | 5/1995 | Wu et al. | 101/420 |
| 5,415,098 | 5/1995 | Ward | 101/493 |

*Primary Examiner*—Edgar Burr
*Assistant Examiner*—Dave A. Ghatt
*Attorney, Agent, or Firm*—Miller, Sisson, Chapman & Nash, P.C.

[57] ABSTRACT

A film and method for attachment of the film to the surface of a transfer cylinder of an ink printing press. A film base sheet coated with micro-particles of aluminum oxide is releaseably attachable to the outer surface of the cylinder by appropriate adhesives.

6 Claims, 3 Drawing Sheets

METHOD AND FILM FOR COATING A TRANSFER CYLINDER IN A PRINTING PRESS

BACKGROUND OF THE INVENTION

Applicant's invention relates to printing presses and, more particularly, to an improved surface coating for transfer cylinders within the presses. Currently, presses utilize loose sliding stretchable nets wrapped about the entire cylinder surface. Typical of these types of nets is the SUPER BLUE® net manufactured by Printing Research, Inc. of Dallas, Tex. These nets are loosely-woven, stretchable fabrics similar to a gauze or cheesecloth. The netting manufacturers recommend that the netting be inspected weekly to ensure the net is loose enough to be pulled away from the transfer cylinder surface ½" to 3" depending on press size. If the net is too loose or too tight, it must be tightened and trimmed or loosened, as the case may be, to within certain tolerances. Once the net has lost its stretch, it must be changed. The nets may not be treated with solvents because this will cause damage to the net and result in marking problems.

Additional problems with the nets include, but are not limited to, the following: (a) the woven fabric may rip, tear, or form holes as the net slips over the cylinder surface during printing; (b) foreign substances may slide under the net, between the fibers, and cause the net to snag; (c) the net may tighten during cylinder operation causing the net to leave its pattern in the image area; and (d) the hook and loop fasteners become loose or detached, resulting in marking problems.

Experience has shown that the average life expectancy of existing nets is two to three weeks with careful and proper adjustment. Even if somewhat larger life may be achieved, through reduced speeds or other production adjustments, the presses must be shut down frequently to adjust the tension of the nets about the cylinders. Considerable expense is currently incurred in fitting, adjusting and maintaining the existing nets.

The present invention provides a unique solution to the long-standing problems with the existing nets. The life expectancy of the film of the present invention is at least 8 to 25 times longer than existing nets. Films of the present invention have run in excess of one year. Additionally, because there is little or no maintenance time involved in adjusting tension, considerable economic savings result from less press downtime.

The film of the present invention may be washed with standard press solvents and cleaners, while remaining fitted to the cylinder surface, without resulting in damage to the film or print marking problems once production is resumed.

SUMMARY OF THE INVENTION

The present invention is an attachable film in combination with a transfer cylinder of a sheet-fed ink printing press. The film has an underlying film base sheet with a micro coating of abrasive, wear resistant, particles of approximately 10–50 microns in diameter affixed to and covering the upper surface of the film base sheet. The underside surface of the film base sheet is smooth and will readily accept or receive and retain an adhesive coating for releaseably securing the film base sheet to the outer surface of the cylinder. Films found preferable for use have previously been used as metal polishing tools in the automotive and sheet metal polishing industry. There is absolutely no teaching, suggestion or disclosure that such abrasive polishing films would be useful to coat the outer surface of a transfer cylinder in an ink printing press.

The present inventive method involves cutting a film having the characteristics described herein to fit about the outer surface of a transfer cylinder, applying a suitable adhesive to the outer cylinder surface, and releaseably securing the film base sheet to the outer surface of the cylinder. Because there is no appreciable stretch in the film, the cutting and fitting of the film to the cylinder takes far less time and requires little or no continuing maintenance.

BRIEF DESCRIPTION OF THE DRAWINGS

In the drawings, wherein like reference characters designate similar features throughout the various views to facilitate comparison.

DETAILED DESCRIPTION OF THE PREFERRED EMBODIMENT

Figure 1:
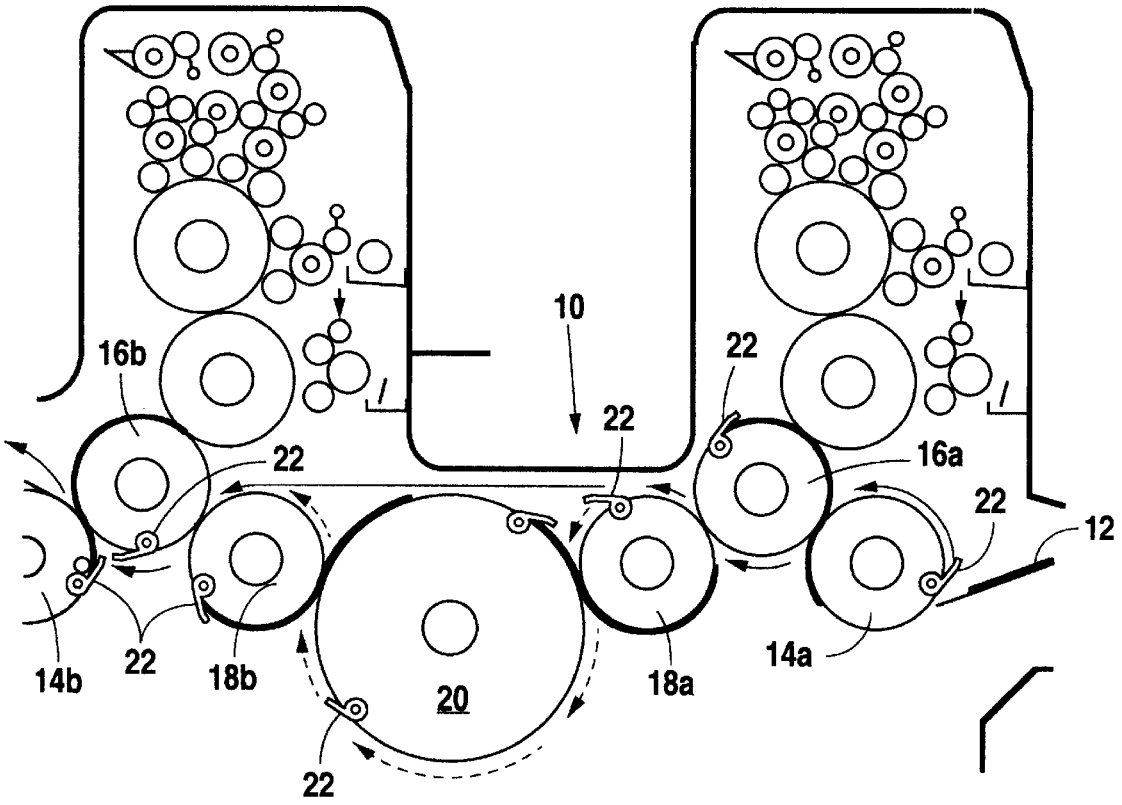
FIG. 1 illustrates the typical flow path of paper sheets through an ink printing press having two transfer cylinders equipped with the film of the present invention.

For the purposes of promoting an understanding of the principles of the invention, reference will now be made to the embodiments illustrated in the drawings and specific language will be used to describe the same. It will nevertheless be understood that no limitations of the scope of the invention is thereby intended, such alterations and further modifications in the illustrated device, and such further applications of the principles of the invention as illustrated therein, being contemplated as would normally occur to one skilled in the art to which the invention relates.

FIG. 1 illustrates the typical sheet flow path through an ink printing press (10). While the specific details of various press roller and cylinder orientation may vary according to the press style, most presses have a sheet feed tray (12), blanket rollers or cylinders **(14*a* and 14*b*), plate rollers or cylinders (16*a* and 16*b*), transfer cylinders or rollers (18*a* and 18*b*), and a perfect cylinder or roller (20)**. Each cylinder has grippers or clips which grasp the individual paper sheet stock and hold the sheets through the run.

In FIG. 1, a straight or line feed route is shown in the solid directional arrows. An alternative route shown in the broken arrows occurs when the perfect cylinder is used to reverse the printing operation as is well known in the art.

Figure 2A:
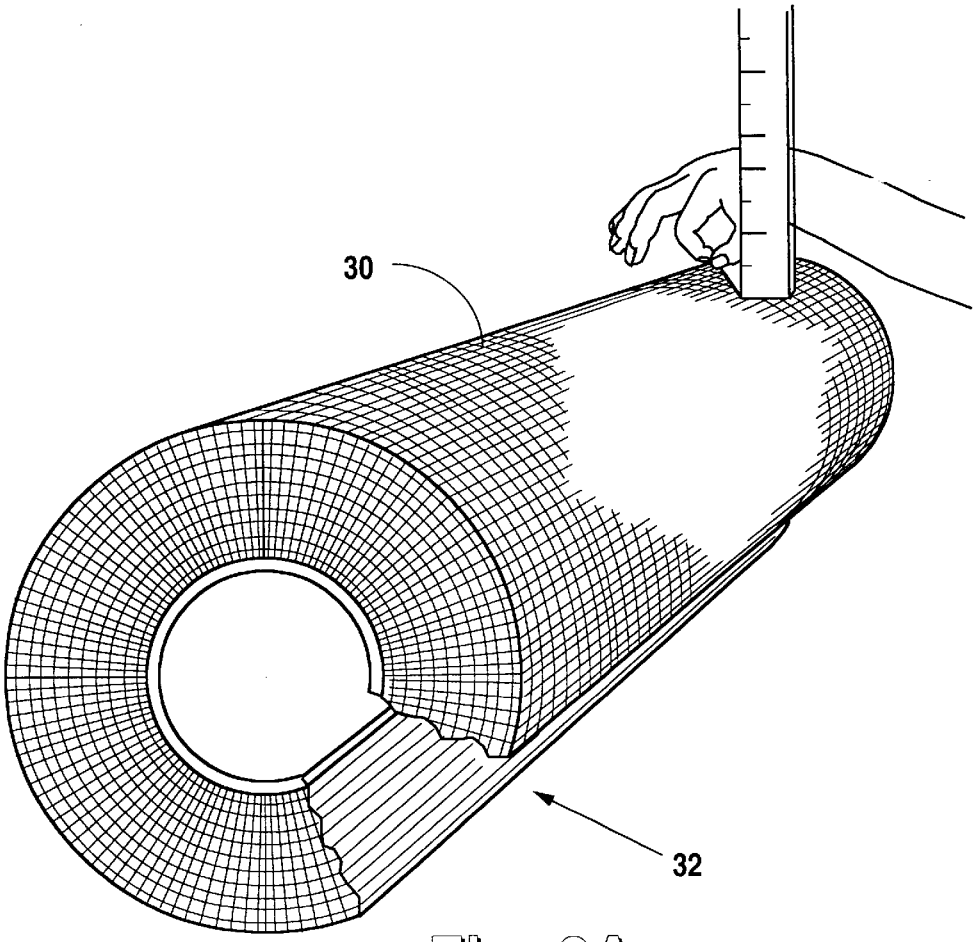
Fig. 2A (PRIOR ART)
FIG. 2A shows a prior art net being measured for proper tensioning.
Figure 2B:
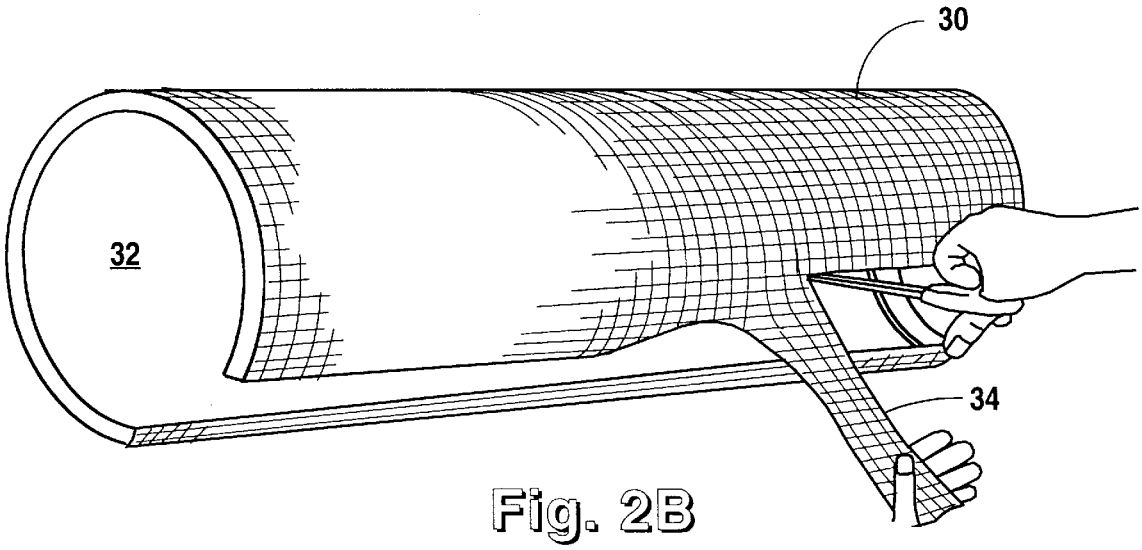
Fig. 2B (PRIOR ART)
FIG. 2B illustrates a prior art net being trimmed to remove excess netting.

The present inventive film and method relates to the covering of the transfer cylinders **(18*a* and 18*b*). FIGS. 2A and 2B illustrate the prior art nets (30) currently used to cover a transfer cylinder (32). As may be seen, and is well known in the art, the existing nets are loose, sliding, stretchable fabrics similar to gauze or cheesecloth which are fitted around the outer surface of the cylinder (32). FIG. 2**A shows that a certain amount of slack or looseness is necessary for proper functioning. Netting manufacturers specify that proper printing can only be accomplished if the net is loose and can move freely over the entire cylinder surface.

As stated above, maintaining proper fit of the net requires considerable press down time. FIG. 2B shows the prior art net (30) being trimmed along the tail (34). Such trimming is not only required when a new net is installed, but nets are often required to be trimmed throughout the life of the net to ensure proper fit over the cylinder. When the net has lost its stretch, it must be replaced.

Figure 3:
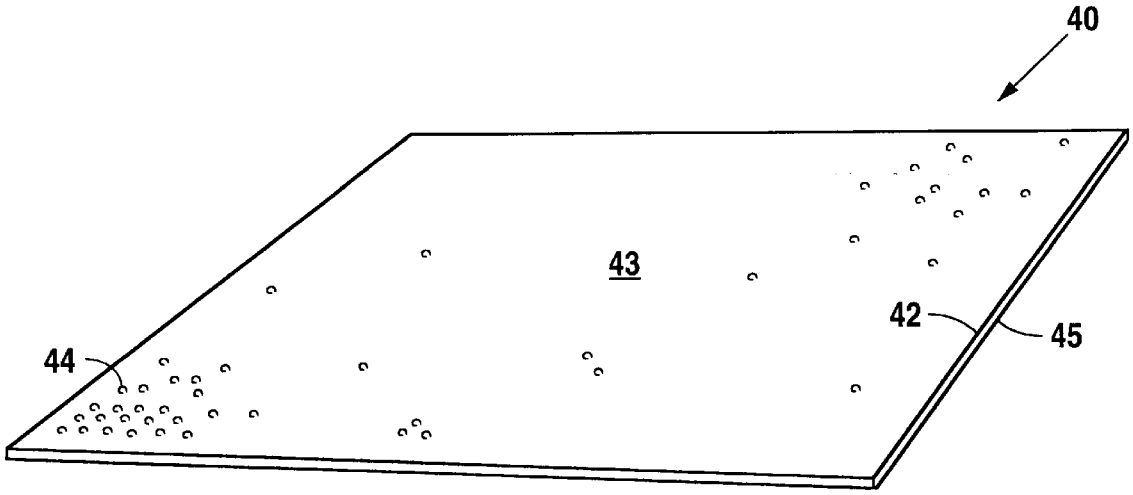
FIG. 3 illustrates a top perspective view of the film of the present invention.

FIG. 3 illustrates a perspective view of the film (40) of the present invention. A thin, flexible, impermeable polyester (or other comparable material) film base sheet (42) is coated along one surface (43) with a micro-coating of fine, small, rigid particles (44) which have diameter in the range of 10–50 microns. A true upper limit on size has not been determined, but is not expected to exceed 100 microns. The particles are preferably of aluminum oxide composition, but nearly any hard, wear-resistant, abrasive-like composition including silicon oxide or even ceramics are believed to be acceptable. The composition utilized depends upon the wear resistance of the particle and cost of production. Abrasive metal polishing sheets have proven effective films for covering transfer cylinders in the present inventive method. Most abrasive polishing films having fine micro-particles may be effective.

Figure 4:
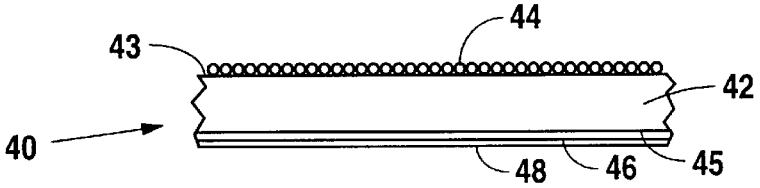
FIG. 4 shows a greatly enlarged side elevation view of a small section of the film of the present invention.

FIG. 4 illustrates a small section of the film (40), greatly enlarged to show the particles (44) affixed to and covering the top surface (43) of the film base sheet (42). It is believed that the particles do not accept printing ink along the outer surface of the particle. Because each particle is raised above the film base sheet surface, the only contact between the film and the printed sheet is along the top edges of the particles. Little or no ink from the printed sheets transfers to the particles; therefore, there is little or no marking on the prints.

It has been found that the films (40) of the present invention may be quickly, easily, and accurately pre-trimmed to fit the transfer cylinders, thereby significantly reducing the time required to cover a cylinder. The prior art nets are stretchable and more difficult to cut and fit. FIG. 4 also shows that an adhesive layer (46) may be applied to the bottom surface (45) of the film base sheet (42) during manufacture of the film and covered with a quick-release cover sheet. This also facilitates pre-cutting and movement of the film (40) during installation.

Figure 5:
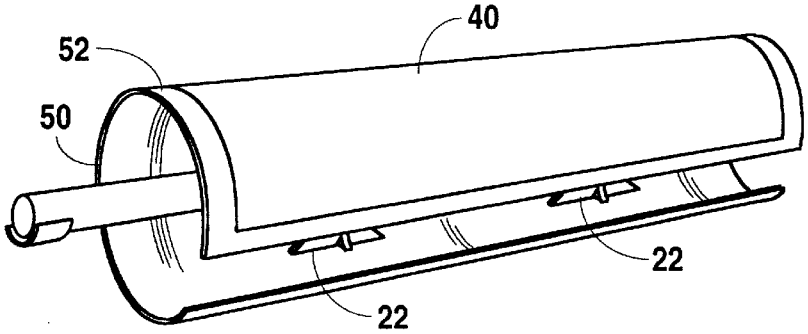
FIG. 5 illustrates a perspective view of a transfer cylinder having the film of the present invention releaseably affixed to the outer surface of the transfer cylinder.

FIG. 5 shows a cylinder (50) covered along its outer surface (52) with the film (40) of the present invention. A precut sheet was trimmed as necessary to cover the surface of the cylinder (50). The cover sheet (48) was removed and the film releaseably secured to the cylinder surface by attaching a leading edge of the sheet to the cylinder and "jogging" or gradually rotating the cylinder while pressing the sheet against the cylinder surface. In some operations, it is more convenient to utilize a film without the pre-attached adhesive layer. In such cases, the operator applies adhesive to the smooth underside (45) of a film base sheet (42) and to the cylinder surface (52). The film (40) is then wrapped around the cylinder by "jogging" the cylinder to releaseably secure the film to the cylinder.

Thus, the cylinder is covered with a non-slip film which may be washed by standard press cleaning solutions and solvents without causing the film to shift or loosen. The particles in the coating are insoluble in press ink and wear-resistant sufficiently to provide raised particle surfaces for contacting the printed sheets.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A method for coating the outer surface of a cylinder of an ink printing press comprising the steps of:

cutting a film to fit about said outer surface of said cylinder, said film further comprising:

a film base sheet having a first surface and a second surface;

a micro-coating of rigid particles affixed to and covering said first surface, said particles insoluble in press ink, said second surface adapted to receive and retain an adhesive coating;

applying said adhesive coating to said outer surface of said cylinder; and releaseably securing said sheet to said outer surface of said cylinder.

2. The method of claim 1, wherein said micro-coating is an aluminum oxide composition.

3. The method of claim 2, wherein said particles are approximately 15 microns in diameter.

4. The method of claim 1, wherein particles are approximately 10–50 microns in diameter.

5. The method of claim 1, wherein said second surface is covered with second adhesive, said second adhesive covered by a releaseable cover sheet.

6. The method of claim 1, wherein said cylinder is a transfer cylinder of a sheet-fed, ink printing press.

* * * * *